US005259071A

United States Patent [19]

Scott et al.

[11] Patent Number: 5,259,071

[45] Date of Patent: Nov. 9, 1993

[54] SAFETY HELMET AND LINER

[76] Inventors: Danny E. Scott, 3371 W. Indianapolis; Loy L. Earles, 3583 W. McKinley, both of Fresno, Calif. 93722

[21] Appl. No.: 874,504

[22] Filed: Apr. 27, 1992

[51] Int. Cl.[5] ..... A42B 3/10

[52] U.S. Cl. ..... 2/413; 2/410

[58] Field of Search ..... 2/410, 411, 413, 424, 2/425, 171.3, 412; 251/322, 323

[56] References Cited

U.S. PATENT DOCUMENTS

| | | | |
|---|---|---|---|
| 3,806,950 | 4/1974 | Spencer-Foote | 2/413 |
| 3,849,801 | 11/1974 | Holt et al. | 2/413 |
| 4,023,213 | 5/1977 | Rovani | 2/413 |
| 4,035,846 | 7/1977 | Jencks | 2/413 |
| 4,060,855 | 12/1977 | Rappleyea | 2/413 |
| 4,572,163 | 2/1986 | Collins et al. | 251/322 |
| 4,586,200 | 5/1986 | Poon | 2/413 |
| 5,003,631 | 4/1991 | Richardson | 2/413 |
| 5,014,365 | 5/1991 | Schulz | 2/413 |
| 5,014,366 | 5/1991 | Discipio, Sr. | 2/413 |
| 5,056,162 | 10/1991 | Tirums | 2/412 |

*Primary Examiner*—Clifford D. Crowder
*Assistant Examiner*—Michael A. Neas
*Attorney, Agent, or Firm*—Leon Gilden

[57] ABSTRACT

A helmet of a rigid construction includes an interior fabric surface removably mounting an inflatable pneumatic liner therewithin. The liner includes an inflation valve and a deflation valve for selective inflation of the liner. A modification of the invention includes the liner formed with a plurality of positioning projections, with each projection in pneumatic communication with a ventilation conduit, whereupon air directed at the liner is projected interiorly of the helmet through the projections.

2 Claims, 4 Drawing Sheets

SAFETY HELMET AND LINER

BACKGROUND OF THE INVENTION

1. Field of the Invention

The field of invention relates to helmet construction, and more particularly pertains to a new and improved safety helmet and liner wherein the same is directed to the protection of an individual.

2. Description of the Prior Art

Helmets of various types have been utilized in the prior art to afford cushioning and protection to an individual to minimize injury to the individual during impact. Such helmet construction is indicated in the U.S. Pat. Nos. 4,035,846; 4,821,344; 4,944,044; 3,761,959; and 4,794,652.

The helmet construction of the instant invention affords advantages over the prior art by providing for a removable liner having a pneumatic chamber directed throughout, as well as optional ventilation construction therethrough.

Accordingly, it may be appreciated that there continues to be a need for a new and improved safety helmet and liner as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of helmet construction now present in the prior art, the present invention provides a safety helmet and liner wherein the same provides for a removable pneumatic liner mounted within a rigid helmet. As such, the general purpose of the present invention, which will be described subsequently in greater detail, is to provide a new and improved safety helmet and liner which has all the advantages of the prior art helmet construction and none of the disadvantages.

To attain this, the present invention provides a helmet of a rigid construction including an interior fabric surface removably mounting an inflatable pneumatic liner therewithin. The liner includes an inflation valve and a deflation valve for selective inflation of the liner. A modification of the invention includes the liner formed with a plurality of positioning projections, with each projection in pneumatic communication with a ventilation conduit, whereupon air directed at the liner is projected interiorly of the helmet through the projections.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved safety helmet and liner which has all the advantages of the prior art helmet construction and none of the disadvantages.

It is another object of the present invention to provide a new and improved safety helmet and liner which may be easily and efficiently manufactured and marketed.

It is a further object of the present invention to provide a new and improved safety helmet and liner which is of a durable and reliable construction.

An even further object of the present invention is to provide a new and improved safety helmet and liner which is susceptible of a low cost of manufacture with regard to both materials and labor, and which accordingly is then susceptible of low prices of sale to the consuming public, thereby making such safety helmets and liners economically available to the buying public.

Still yet another object of the present invention is to provide a new and improved safety helmet and liner which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
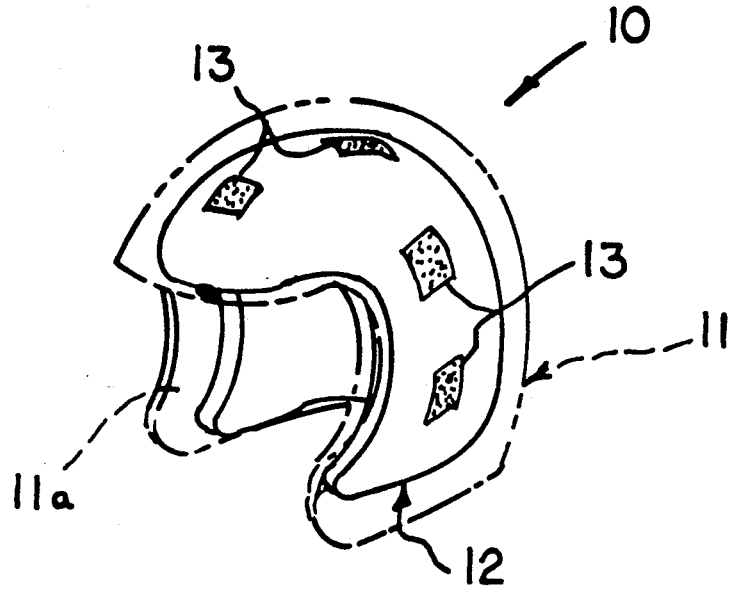
FIG. 1 is an isometric illustration of the instant invention.
Figure 2:
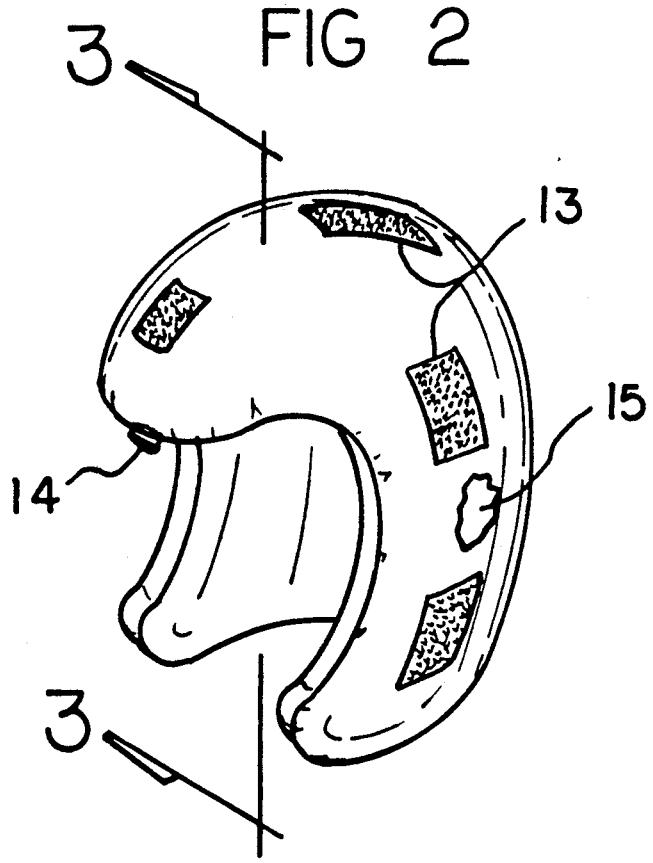
FIG. 2 is an isometric enlarged view of the liner construction.
Figure 3:
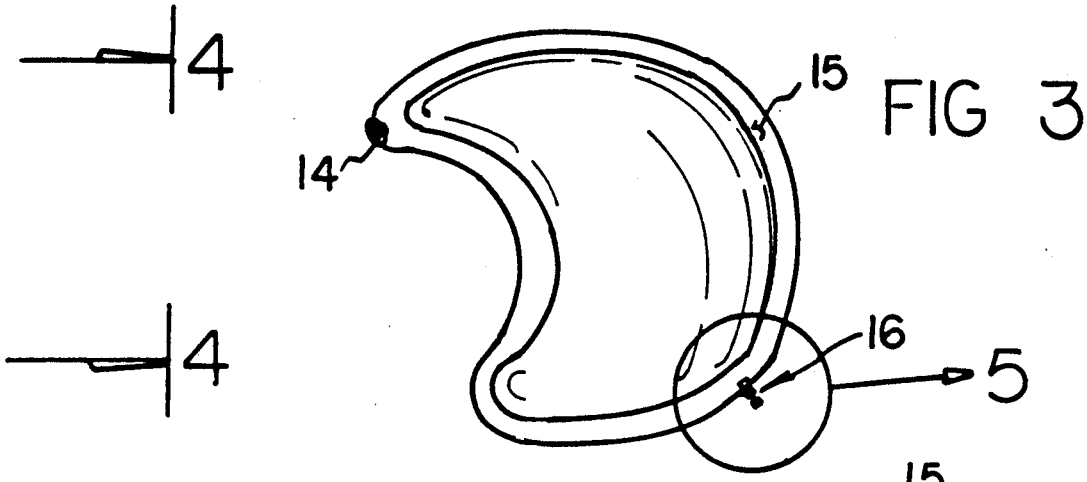
FIG. 3 is an orthographic view, taken along the lines 3—3 of FIG. 2 in the direction indicated by the arrows.

With reference now to the drawings, and in particular to FIGS. 1 to 10 thereof, a new and improved safety helmet and liner embodying the principles and concepts of the present invention and generally designated by the reference numeral 10 will be described.

More specifically, the safety helmet and liner 10 of the instant invention essentially comprises an outer rigid helmet 11 having an inner fabric web 11*a* directed coextensively within an interior surface of the helmet 11. An inflatable liner 12 is provided having an exterior surface formed with a plurality of hook and loop fastener patches 13 mounted thereto for selective securement to the fabric web 11*a*. An inflation tube 14 is mounted in pneumatic communication with an interior pneumatic chamber 15 of the liner that in turn is coextensively directed throughout the liner. A deflation valve 16 is mounted adjacent a lower rear distal end portion of the liner to effect selective deflation of the liner. The inflation tube 14 is arranged with a one-way valve construction to prevent one-way air flow therethrough for ease of inflation of the liner for use. The inflation tube may be of a tube type to permit oral inflation or requiring an external pressurized source, such as indicated in U.S. Pat. No. 3,761,959 incorporated herein by reference. An oral inflation tube may be utilized of a type as indicated in the U.S. Pat. No. 4,035,846 incorporated herein by reference.

Figure 5:
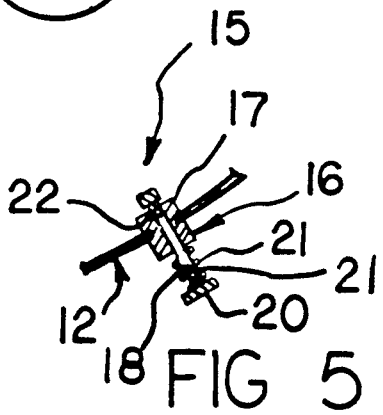
FIG. 5 is an orthographic cross-sectional illustration of section 5 as set forth in FIG. 3.
Figure 6:
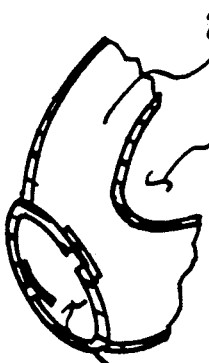
FIG. 6 is an isometric illustration of the section 6—6 of FIG. 4.
Figure 4:
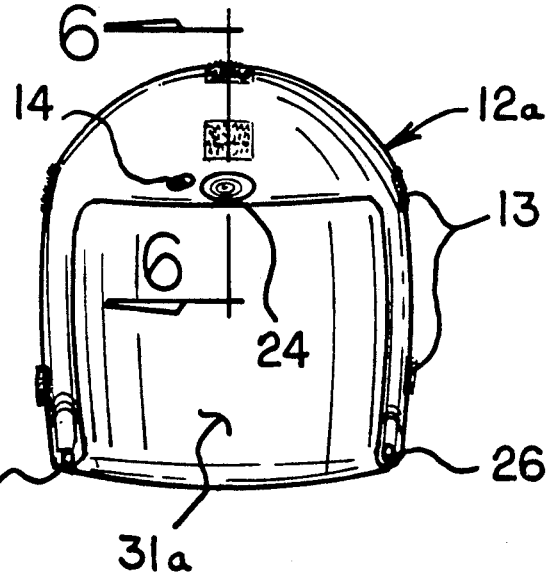
FIG. 4 is an orthographic view, taken along the lines 4—4 of FIG. 3 in the direction indicated by the arrows.
Figure 7:
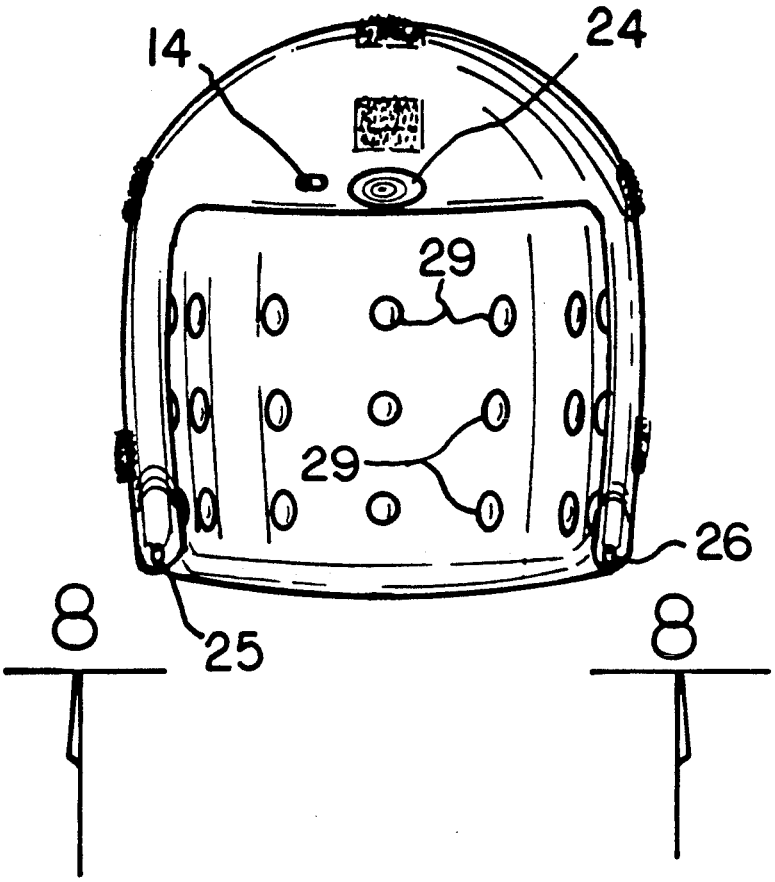
FIG. 7 is an isometric illustration of a modified aspect of the invention, as indicated in FIG. 4.
Figure 8:
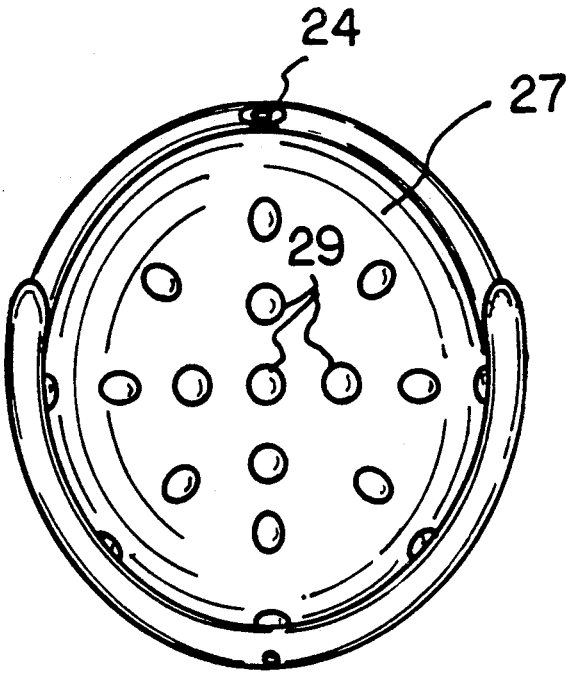
FIG. 8 is an orthographic view, taken along the lines 8—8 of FIG. 7 in the direction indicated by the arrows.
Figure 9:
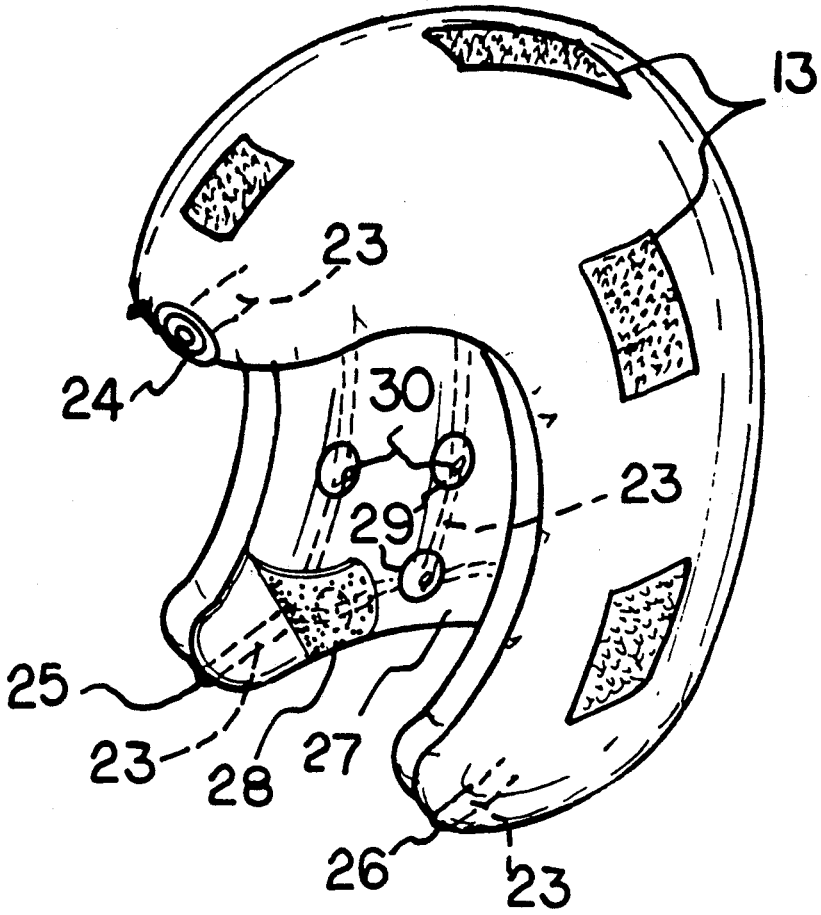
FIG. 9 is an isometric enlarged illustration of the modified aspect of the invention indicating the various ventilation conduits directed therethrough and their inter-relationship relative to the positioning projections.
Figure 10:
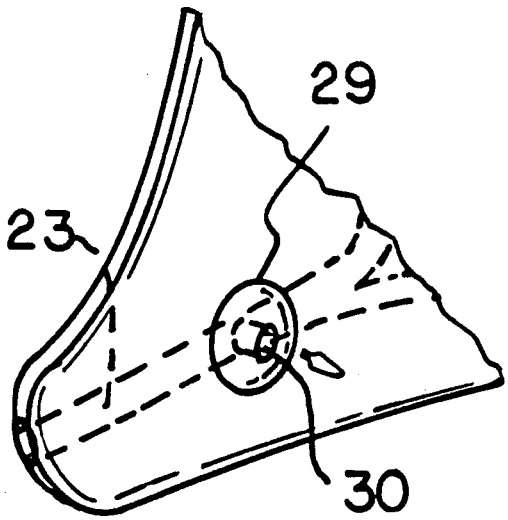
FIG. 10 is an enlarged isometric illustration of the liner construction of FIG. 9.

Deflation valve 16 (see FIG. 5) is arranged and mounted through the liner 12 into pneumatic communication with the pneumatic chamber 15, in a manner as illustrated in FIG. 5. A mounting block 17 is fixedly secured to the outer wall of the liner 12 having a bore directed therethrough slidably receiving a deflation tube 18 therethrough. The deflation tube 18 has a cap 19 mounted at an outer distal end spaced from the liner 12, with a spring 20 interposed between the cap 19 and the mounting block 17 to normally bias the deflation tube 18 into a retracted orientation with the pneumatic chamber 15, as illustrated in FIG. 5. An outer exit port 21 is positioned and directed through the tube 18 adjacent the cap 20 in pneumatic communication through the tube 18, with an inner exit port 22 positioned adjacent an interior distal end of the tube 18, with the inner exit port 22 positioned in a first position within the mounting block 17, whereupon projection and depressing of the tube 18 for projection of the tube within the chamber 15 exposes the inner exit port 22 to permit pressurized air from within the chamber 15 to be directed from the chamber into the inner exit port 22 and to escape from the chamber through the outer exit port 21.

The FIGS. 4 and 6–10 indicate the use of a ventilation conduit 23 contained within the pneumatic chamber 15 directed coextensively throughout the chamber in pneumatic communication with an upper entrance 24 directed through an upper peripheral end of the liner above a facial opening 31*a* of the liner, with first and second lower outlet ports 25 and 26 in pneumatic communication through the upper entrance port 24 through the ventilation conduit 23, with the first and second lower outlet ports 25 and 26 positioned adjacent lower distal ends of the liner at a lower distal end of the facial opening 31*a*. The ventilation conduit 23 is directed throughout the pneumatic chamber 15 as discussed above, with a plurality of semispherical positioning projections 29 mounted to an interior surface of the liner. Each of the projections 29 include a projection conduit 30 directed therethrough, whereupon pressurized air directed through the ventilation conduit 23 during use of the helmet such as in a motorcycle environment, directs ventilation throughout the ventilation conduit for directing the air into the interior surface of the liner through the projection conduits 30 for cooling of an individual wearing the helmet construction. The liner interior surface 27 may be further formed with an adhesive layer 28 as indicated in the FIG. 9 positioned in surrounding relationship relative to the projections 29 to modify the interior size of the liner for accommodating a larger geometric configuration of a head of an individual.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A safety helmet and liner, comprising, an outer rigid helmet, the outer rigid helmet including an outer helmet interior surface, with the outer helmet interior surface having an inner fabric web coextensively mounted thereon, and an inflatable liner, the inflatable liner having a liner outer surface, with the liner outer surface having a plurality of hook and loop fastener patches mounted fixedly thereon for selective securement to the fabric web, and the liner has a pneumatic chamber directed coextensively within the liner, with an inflation tube directed into the pneumatic chamber, and a deflation tube directed into the pneumatic chamber, and the deflation valve has a mounting block fixedly mounted through the liner into the pneumatic chamber, the mounting block including a mounting block bore directed therethrough, with a deflation tube slidably mounted within the bore, the deflation tube having a deflation tube cap formed at an outer distal end of the deflation tube, and a spring interposed between the cap and the mounting block to bias the deflation tube in a displaced orientation with the pneumatic chamber directed into the mounting block, and the deflation tube having an outer exit port directed through the deflation tube adjacent the cap in pneumatic communication with an inner exit port through the deflation tube, with the inner exit port positioned within the mounting block in a first position and the inner exit port displaced relative to the mounting block positioned within the pneumatic chamber in a second position when the deflation tube cap is manual displaced towards the mounting block, and the liner having a liner interior surface, the liner interior surface including a matrix of semi-spherical positioning projections projecting interiorly of the liner from the liner interior surface, and a ventilation conduit contained within the liner directed through the pneumatic chamber, with the ventilation conduit including a ventilation conduit upper entrance positioned above a facial opening of the liner, and a respective first and second ventilation conduit outlet port in pneumatic communication with the ventilation conduit and the upper entrance, with the first and second outlet ports positioned adjacent a lower end portion of the facial opening, and each positioning projection including a projection conduit directed through the positioning projection, and each projection conduit in pneumatic communication with the ventilation conduit.

2. A helmet and liner as set forth in claim 1 with the liner interior surface including an adhesive layer removably mounted relative to the liner interior surface, with the adhesive layer arranged in surrounding relationship to each positioning projection permitting selective removal of the adhesive layer.

* * * * *